United States Patent [19]

Carrish

[11] Patent Number: 4,842,262

[45] Date of Patent: Jun. 27, 1989

[54] DOCUMENT INVERTER

[75] Inventor: Jeffrey J. Carrish, Milford, Mass.

[73] Assignee: Delphax Systems, Randolph, Mass.

[21] Appl. No.: 582,244

[22] Filed: Feb. 22, 1984

[51] Int. Cl.[4] ..... B65H 29/20

[52] U.S. Cl. ..... 271/186; 271/902

[58] Field of Search ..... 271/186, DIG. 9, 291, 271/224, 225, 902

[56] References Cited

U.S. PATENT DOCUMENTS

| | | | |
|---|---|---|---|
| 3,148,879 | 9/1964 | Kistner | 271/224 X |
| 3,501,139 | 3/1970 | Stobb | 271/186 |
| 3,523,687 | 8/1970 | Petersen | 271/186 X |
| 4,054,285 | 10/1977 | Stange | 271/186 |
| 4,078,789 | 3/1978 | Kittredge | 271/186 X |
| 4,486,012 | 12/1984 | Böck | 271/186 X |
| 4,512,255 | 4/1985 | Christ | 271/186 X |

FOREIGN PATENT DOCUMENTS

| | | | |
|---|---|---|---|
| 2151083 | 4/1973 | Fed. Rep. of Germany | 271/224 |
| 69534 | 6/1977 | Japan | 271/186 |
| 72562 | 5/1982 | Japan | 271/186 |
| 72563 | 5/1982 | Japan | 271/186 |

OTHER PUBLICATIONS

IBM Technical Disclosure Bulletin, vol. 18, No. 1, p. 40, Jun. 1975, "Sheet Turnover Device", S. R. Harding.

IBM Technical Disclosure Bulletin, vol. 18, No. 1, p. 22, Jun. 1977, "Sheet Reverser", M. K. Bullock.

IBM Technical Disclosure Bulletin, vol. 19, No. 2, p. 4496, May 1977, "Duplex Document Feeder", M. K. Bullock.

*Primary Examiner*—Richard A. Schacher

*Attorney, Agent, or Firm*—Arthur B. Moore

[57] ABSTRACT

Sheet turnover apparatus of particular utility in the document-delivery system of a high speed printer, copier, or the like. Documents are serially routed through an infeed nip of a three-roller assembly, and received by a narrow, angularly-profiled chute. The chute includes a recoil assembly at its far end, which causes the document to reverse its travel within the chute to be directed toward the outfeed nip of the roller assembly. A paddle or flipper assembly mounted to the central roller of the roller triad directs the trailing edge of the document from infeed nip to outfeed nip, where it becomes the document's leading edge.

19 Claims, 3 Drawing Sheets

DOCUMENT INVERTER

BACKGROUND OF THE INVENTION

The present invention relates to document-delivery systems, and more particularly to apparatus for inverting documents.

In systems for handling sheets such as sheets of paper it is sometimes desirable to provide the capability of inverting these so that they face in the opposite direction. One example of this is the stacking of a plurality of documents which are serially delivered to a receptacle with an imprinted face upward. These documents will be incorrectly collated with the first-delivered document at the bottom of the stack, unless some means is provided to ensure that the imprinted face will be downwardly oriented (i.e. to flip the document over prior to stacking).

A number of approaches to this problem have been adopted in the prior art. Some of these systems use an array of sheet-engaging mechanisms, such as conveyor belts or rollers which guide the sheets in a circuitous path to achieve the desired shift of orientation. These systems typically occupy an extensive volume and are therefore undesirable in an efficient, compact document-delivery system. Illustrative patents include U.S. Pat. Nos. 4,359,217; 4,264,067; 3,948,385; 4,027,870; and 4,019,435. Another approach utilizes a device to receive the sheet, firmly retain the sheet during rotation or other motion, and release the sheet in an inverted condition. Patents disclosing such systems include, for example, U.S. Pat. Nos. 4,385,756; 4,252,309; and 3,904,192. These devices generally are unduly complex and susceptible to failure, and may provide difficulties in adapting to a variety of sheet lengths.

Still another approach to this problem utilizes a sheet-receiving chute, pocket, or similar structure, together with mechanisms for forcing the sheet into the pocket in one orientation, and receiving or actively withdrawing the sheet in an inverted state. U.S. Pat. No. 3,523,687 to Petersen et al. discloses a series of "angular races", together with a drive roller which frictionally guides the sheet into and out of the races to invert the sheet. The mechanisms disclosed in this reference will tend to encounter difficulties in handling sheets with structural imperfections such as ragged edges, inasmuch as they rely on the engagement between the sheet and a roller having an elastomeric surface. This arrangement may not overcome the paper's tendency to curl in a manner so as to prevent its intended exit.

U.S. Pat. No. 4,078,789 to Kittredge et al. discloses several embodiments wherein a sheet is guided into a chute or chimney, and caused to emerge in an inverted orientation, using a triad of guide rollers at the mouth of the chute. In the embodiment of FIG. 1, the sheet is directed downwardly into a chute, where its presence is detected using a sensor. Upon detection of the sheet, a roller is pivotted into engagement therewith to positively drive the sheet out of the chute. This approach requires apparatus for sensing the sheet, as well as complex mechanisms for engaging the sheet—features which may limit throughput rates and lead to reliability problems. In the embodiment of FIG. 3, which also employs a triad of drive rollers, the sheet is forced upwardly into a chimney, where it strikes a stationary stop member and rebounds, inverted, toward the exit nip. Applicant has observed that systems of this type which largely rely on gravity are inflexible, i.e. difficult to adapt to a variety of sheet lengths and basis weights.

U.S. Pat. No. 4,054,285, to Stange et al., discloses apparatus for guiding the sheet into a rectangular pocket, where it is sensed and forced out of the pocket using a "fluid stream".

Accordingly, it is a primary object of the invention to provide simple, reliable apparatus for inverting documents. Desirably, such apparatus should be well suited to incorporation in a high-speed document-delivery system.

Another object is to avoid the use of elements such as sensor apparatus or complex paper-handling mechanisms. A related object is to achieve a relatively maintainance-free system. An additional related object is avoiding the need to synchronize the operation of the inverting apparatus with the remainder of the system.

Still another object is to allow the adaptation of this system to a variety of parameters in the documents to be handled, including different sheet lengths and basis weights. Such adaptation should not require overly complex adjustments of the document-inverter device.

A further object is the capability of handling substrates having structural imperfections, such as ragged or curled edges.

SUMMARY OF THE INVENTION

In furthering the above and additional objects, the invention provides document-inverter apparatus in which documents are transported into and out of a chute via a roller assembly, said apparatus including mechanisms associated with the chute and roller assembly for ensuring reliable routing of documents at high throughput rates. The roller assembly includes an infeed roller, a central roller, and an outfeed roller, wherein the central roller defines infeed and outfeed nips with the remaining rollers. A flipper assembly mounted to the central roller guides the trailing edge of documents from the infeed nip to the outfeed nip. The chute includes a recoil assembly at its remote end to reverse the travel of documents therein, desirably providing a restoring force to assist in delivery to the outfeed nip.

One aspect of the invention relates to the nature of the recoil assembly. In the preferred embodiment of the invention, this assembly includes a slidably mounted stop member, linked to a light-duty spring, such as a leaf spring. This assembly may be adapted to the handling of longer sheets by allowing for extended travel of the stop member, and incorporating a constant force spring assembly. Although the preferred recoil assembly utilizes a centrally located stop member together with a biasing mechanism to provide a restoring force, other devices may be employed for the purpose such as corner stops. It is an advantageous aspect of the invention that the recoil assembly is passive, requiring no document sensing or other extrinsic actuating mechanism.

Another aspect of the invention is the design of a suitable chute. The chute of the preferred embodiment extends downwardly from the roller assembly, and tapers from a broad region at its mouth to a wall separation illustratively on the order of $\frac{1}{4}$ inch along the remainder of its length. In its preferred profile, it includes a first, vertical section; a second, arcuate section forming an elbow advantageously of 90°; and a third, horizontal portion which includes the recoil assembly. This compact configuration has been observed to permit the simultaneous handling of pairs of serially-fed sheets at high throughput rates.

A further aspect of the invention is the provision of a paddle assembly mounted to the central roller. The roller carries one or more wheels of radially extending paddles, which most preferably are sited in gaps between the sections of a segmented roller. Desirably, these paddles are constructed of a flexible material, thereby to avoid interference at the outfeed nip or damage to the document.

In a preferred embodiment of the invention, the document inverter is incorporated in the document-delivery system of a high speed printer or copier. This system provides the capability of handling a variety of sheet lengths and basis weights, at high throughput rates on the order of 20 to 60 sheets per minute. The document-inverting assembly may also be used to adapt a page printer, such as that described above, to provide duplex (i.e. two-sided) printing capability. In this case, two printing assemblies are provided in tandem, placing the document inverter between these so that they will successively imprint opposite sides of the sheet.

BRIEF DESCRIPTION OF THE DRAWINGS

The above and additional aspects of the invention are illustrated in the following detailed description of the preferred embodiment, taken in conjunction with the drawings in which.

DETAILED DESCRIPTION

Figure 1:
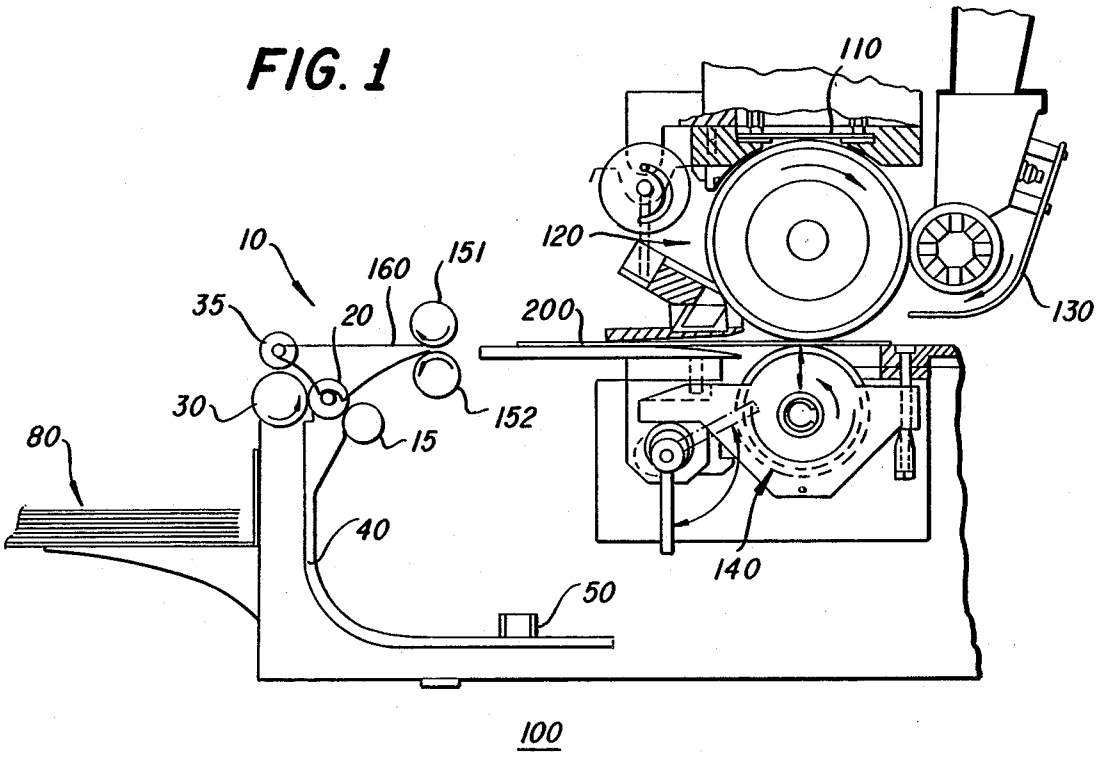
FIG. 1 is a partially sectioned end view of a high-speed printing system incorporating the sheet turnover device of the invention.

FIG. 1 gives an elevation view of document-inverter apparatus 10 in accordance with the preferred embodiment, shown as part of a high speed electrographic printing system 100. Printer 100, illustratively of the type disclosed in U.S. Pat. No. 4,365,549 uses an ion-generating print cartridge 110 to form a latent electrostatic image on the dielectric surface of the rotating imaging cylinder 120. This image is developed using the toning system 130 to form a visible toner image, which is then rotated to the nip with transfer roller 140 for transferring to a sheet of plain paper 200. This transfer may be achieved by means of high pressure between rollers 120 and 140, resulting in simultaneous fixing of the toner image to the sheet 200. This sheet, now bearing the image on its upper face, is routed between outfeed guide rollers 151 and 152, which are placed astride a guide plate 160. Thus, the document 200 passes from rollers 151, 152 along the lower surface of guide plate 160, to the nip between rollers 15, 20, which define the entry to the sheet-inverter apparatus 10.

Sheet 200 is driven by rollers 15 and 20 into the mouth of an angular chute 40 until it reaches a recoil assembly 50. As explained below, recoil assembly 50 arrests the leading edge of document 200 within chute 40, and redirects the sheet toward the mouth of the chute where it exits through the outfeed nip between rollers 20 and 30. The paper then proceeds between rollers 30 and 35 and is delivered to a bin 80 (shown in part) for stacking, with the imprinted face now downwardly inverted.

Alternatively, the document-inverting apparatus of the invention may be incorporated in a duplex page printing or copying system. In this application, two page printing or copying assemblies are used in tandem, wherein the imprinted page emerging from the first assembly passes through the document inverter before being fed to the second assembly.

Figure 2:
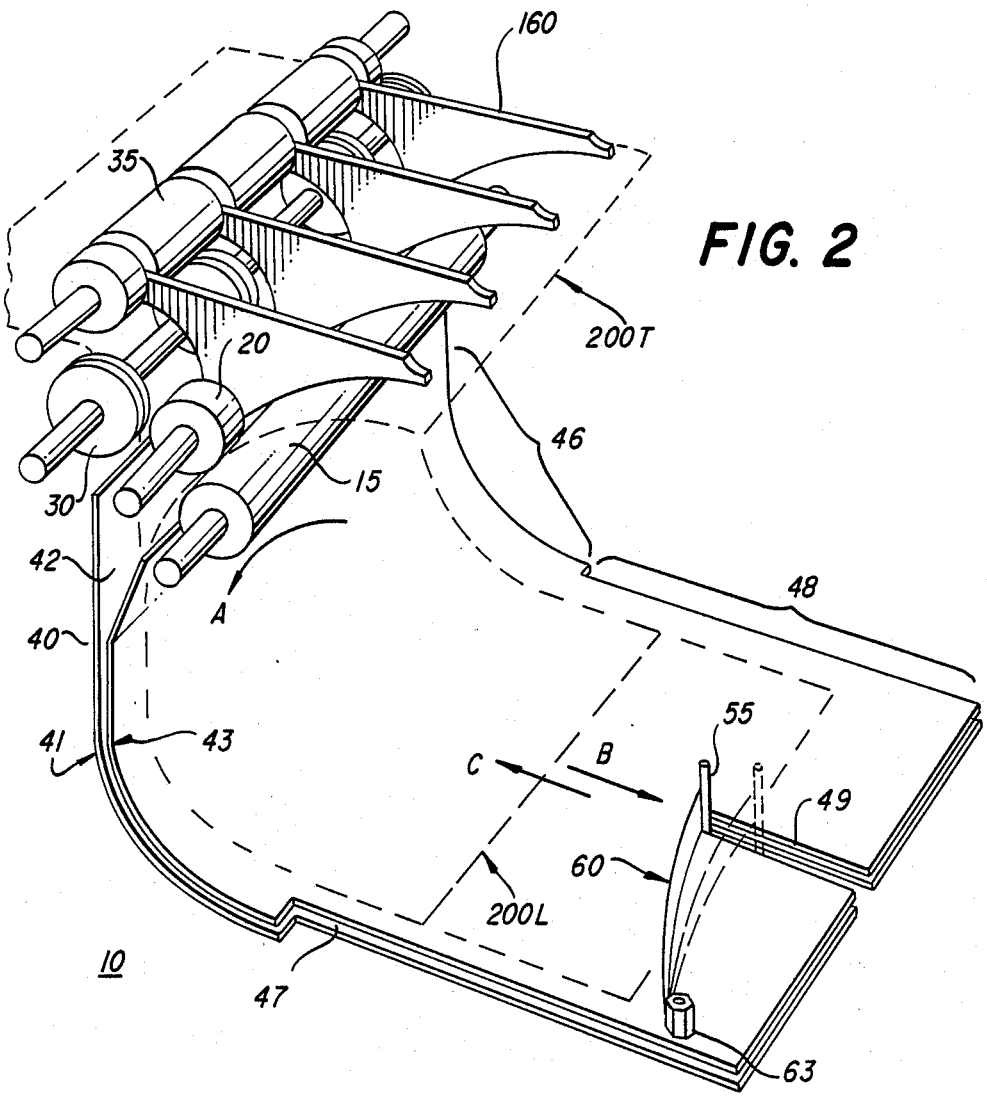
FIG. 2 is a perspective view of the sheet turnover device of FIG. 1.

FIG. 2 shows a preferred design of document-inverting apparatus 10, isolated from other elements of the document-delivery system. Chute 40 consists of two plates 41 and 43, defining a narrow channel 47. The paper is delivered as generally indicated by arrow A between rollers 15 and 20 to the mouth 42 of the chute 40, which tapers to a narrow width of channel 47. Plates 41 and 43 are essentially parallel over the remainder of their length, at a separation sufficient to prevent binding of documents 200 but not so great as to permit buckling of the sheet. A gap width of around ¼ inch has been found suitable for this purpose. The chute 40 includes an arcuate region or elbow 46, which in the illustrated embodiment encompasses an angle of 90° and is characterized by a generally circular curvature. An illustrative radius of curvature for this zone is three inches. Elbow 46 interconnects the vertical portion of chute 40 with a horizontal section 48. This preferred configuration provides the advantages of a compact design for the turnover apparatus, permitting it to be conveniently integrated into a document-delivery system. The preferred profile for plate 40 has also proven effective in the routing of paper in the sheet turnover apparatus, particularly paper having a basis weight of between 16 and 28 lbs.

The horizontal segment 48 of chute 40 contains a recoil assembly 50, the purpose of which is to arrest the travel of a document within the chute and assist its travel toward the exit nip formed by rollers 20 and 30. In the embodiment of FIG. 2, the recoil assembly 50 consists of a stop member or roll pin 55 which is slidably mounted in a slot 49 along the longitudinal axis of chute 40. The roll pin 55 is mounted to a light-duty spring 60, which is fixed to support 63. It has been found advantageous to locate roll pin 55 at or near the center line of document 200. Although the recoil assembly of the preferred embodiment incorporates a resilient mechanism to provide a restoring force, it is within the scope of the invention to employ alternative structures such as corner stops.

During operation, a document 200 strikes pin 55 and drives this member in direction B until the paper's kinetic energy is absorbed by the leaf spring 60. Spring 60 rebounds in direction C, thereby driving the paper 200 upwardly within chute 40. During this return travel, document 200 tends to follow the wall 41 of chute 40, and will be naturally directed along this wall to the nip between rollers 20 and 30. With a wall separation of around ¼ of an inch between plates 41 and 43, the assembly 10 will easily accommodate pairs of serially-delivered documents 200, whereby a first document will travel in the outfeed direction along the inner wall of plate 41 while a newly received document will pass through the space between the first document and the opposite plate 43.

Figure 3A:
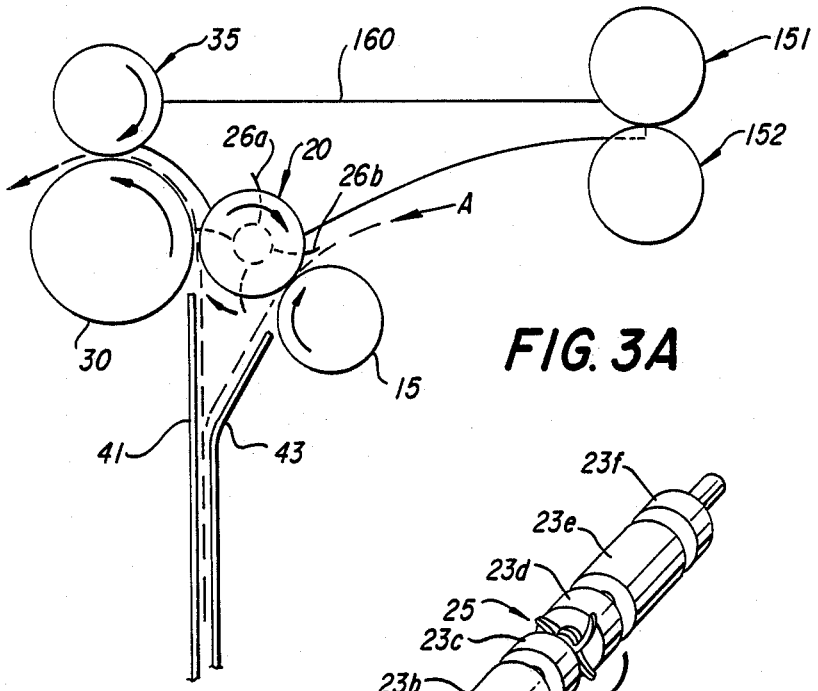
FIG. 3A is a partially schematic end view of the feed roller assembly of the device of FIG. 2.
Figure 3B:
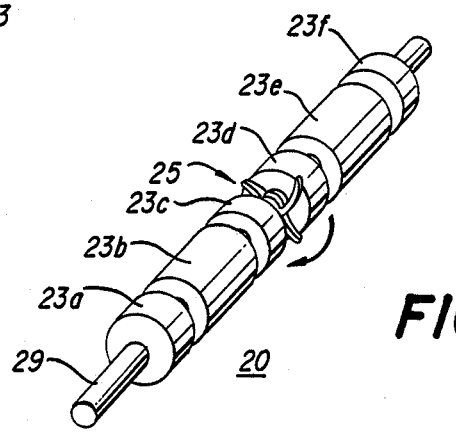
FIG. 3B is a perspective view of the central roller of FIG. 3A.

The apparatus of the present invention includes a paddle or flipper assembly 25 mounted to roller 20 to provide for a reliable delivery of the inverted sheet to the outfeed nip between rollers 20 and 30. As shown in FIGS. 3A and 3B, paddle assembly 25 consists of a wheel of four flexible paddles 26A–26D mounted to the center of the shaft 29 of roller 20. Most conveniently, roller 20 is segmented in sections 23*a*, 23*b*, etc., with one or more paddle assemblies 25 located in a hollow between adjacent roller segments 23. It has been found advantageous to construct the paddles 25 of a flexible plastic, rubber, or other material having a durometer on the order of 20-60 on the Shore A scale. In the illustrated embodiment wherein roller 20 rotates in a clockwise direction, the paddles 26 will tend to adopt a curvature as shown. This paddle composition and configuration is designed in part so that paddles 26 will not jam the outfeed nip nor damage the document 200. The number of paddles 26 in assembly 25 is not critical, but is generally related to the separation between sucessive sheets 200.

In operation, the leading edge 200L of an incoming sheet travelling between rollers 15 and 20 is driven by these rollers against the stop member 55, and displaces this pin until the trailing edge 200T emerges from the infeed nip. At this point, a paddle 26 will contact the edge 200T and guide this edge around the roller 20 toward the outfeed nip. The sheet 200 receives a restoring force from the recoil assembly 50 to overcome the frictional resistance of chute 40 to outfeed travel. Paddle 26 tamps the edge 200T (which now becomes the document's leading edge) into the nip between rollers 20 and 30 to ensure reliable outfeed of the sheet. A 45° angle from the horizontal of the center line of rollers 15, 20 has been observed to facilitate the "walking" of the edge 200T around roller 20. This disposition of rollers 15 and 20 also facilitates the injection of sheet 200 into the mouth 42 of chute 40, and reduces the friction between the newly injected sheet and an exiting sheet along plate 41.

It has been found advantageous to positively drive the central roller 20 in the clockwise sense shown, and for the remaining rollers 15, 30, and 35 to be frictionally driven from roller 20.

Figure 4:
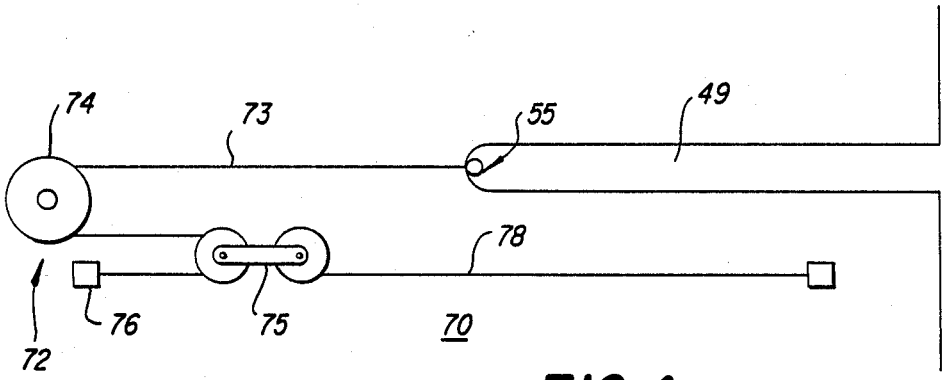
FIG. 4 is a partial view of an alternative form of recoil assembly for the document-inverter apparatus of the invention.

A beneficial feature of the turnover system 10 is its adaptability to a variety of sheet lengths. In order to provide for the handling of longer sheets, such as 14 inch long "legal size" sheets, the horizontal portion 48 of the chute 40 is extended. The channel 47 should be as long as or longer than the sheet 200. When slidably mounting a stop in a slot such as shown in FIG. 2, the slot 49 should be sufficiently long to retain the stop member 55 at its maximum displacement. When accommodating longer sheets, it has been found advantageous to employ the alternative recoil assembly 70 shown in the plan view of FIG. 4. In assembly 70, the back stop or pin 55 is coupled to a constant bias assembly 72, which includes a first bias spring 73 extending from the pin 55 to a fixed pulley 74, and thence through a moveable pulley 75 to ground 76. The moveable pulley 75 is, in turn, coupled to a negator spring 78. This assembly provides a uniform restoring force over a variety of displacements of roll pin 55. This alternative recoil assembly 70 accommodates a range of sheet lengths by avoiding an undesirable buildup of the return force at greater displacements of pin 55.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. Surface reversing sheet-feeding apparatus comprising:

a roller assembly, including an infeed roller wth a curved input guide, a central roller, and a pair of outfeed rollers, wherein said central roller is intermediate to and in driving engagement with said infeed and outfeed rollers, and respectively forms infeed and outfeed nips therewith;

a chute having a mouth adjacent said roller means and defining an interior channel, wherein a sheet passing through the infeed nip will enter said chute, and a sheet contained within the chute can exit through the outfeed nip;

recoil means for arresting the leading edge of a sheet entering the chute and imparting a countervailing force thereto; and a flipper assembly mounted to the central roller to guide the trailing edge of a sheet from the infeed nip to the outfeed nip.

2. Apparatus as defined in claim 1, wherein the recoil assembly comprises:

a stop member slidably mounted to said chute and extending into said channel; and means for biasing said stop member toward the mouth of said chute.

3. Apparatus as defined in claim 2 wherein the biasing means is a light-duty spring.

4. Apparatus as defined in claim 3 wherein the light-duty spring exerts an essentially constant bias over varying displacements of the stop member.

5. Apparatus as defined in claim 1 wherein the recoil assembly comprises a member fixed in a user-selected position.

6. Apparatus as defined in claim 1 wherein the flipper assembly comprises a plurality of radially extending flexible paddles from a core of said central roller.

7. Apparatus as defined in claim 1 wherein the chute extends downwardly from the roller assembly with an arcuate elbow.

8. Sheet-inverting apparatus, comprising:

a roller assembly, including an infeed roller, a central roller, and an outfeed roller, wherein said central roller is intermediate to and in driving engagement with said infeed and outfeed nips therewith;

a curved chute having a mouth adjacent said roller means and extending to a linear interior channel, wherein a sheet passing through the infeed nip will enter said chute, and a sheet contained within the chute can exit through the outfeed nip;

a stop member slidably mounted to said chute and extending into said channel; and means for biasing said stop member toward the mouth of said channel.

9. Apparatus as defined in claim 8, further comprising a flipper assembly mounted to extend from below the central roller to guide the trailing edge of a sheet from the infeed nip to the outfeed nip.

10. Apparatus as defined in claim 9 wherein the flipper assembly comprises a plurality of outwardly extending curved flexible paddles.

11. Apparatus as defined in claim 8 wherein the biasing means comprises a constant bias assembly.

12. Apparatus as defined in claim 11 wherein said constant bias assembly exerts an essentially constant bias over varying displacements of the stop members and includes a first bias spring connected to a fixed pulley and a movable pulley which is in turn connected to a second fixed spring.

13. Apparatus as defined in claim 8 wherein the chute extends downwardly from the roller assembly.

14. Apparatus as defined in claim 13 wherein the chute bends to form an essentially horizontal portion which houses the stop member and biasing means.

15. The method of inverting a sheet of material having opposite surfaces, which comprises the steps of:

(A) feeding the sheet with one surface in an up position to an infeed roller and a central roller at the input to a chute and causing said sheet to enter a channel of said chute;

(B) providing a flexible paddle on said central roller and depressing said paddle below the surface of said roller during infeed of said sheet;

(C) flipping said sheet in said chute to the nip of an outfeed roller and said central roller at the output of said chute;

(D) allowing said paddle to expand above the surface of said roller to contact said sheet and position it for outfeed thereof; and (E) feeding said sheet with the opposite surface up from said output.

16. Method as defined in claim 15, for duplex imaging, wherein the inverted page is delivered to a further image-forming assembly to imprint the opposite face thereof.

17. Method as defined in claim 15 wherein a stop member is slidably mounted in said chute and extending into said channel; and biasing said stop member toward the mouth of said chute.

18. Method as defined in claim 17 wherein said biasing comprises using a light-duty spring.

19. Method as defined in claim 18 wherein an essentially constant bias is exerted over varying displacements of said stop member.

* * * * *